US006173787B1

(12) United States Patent
Wittrisch

(10) Patent No.: US 6,173,787 B1
(45) Date of Patent: Jan. 16, 2001

(54) METHOD AND SYSTEM INTENDED FOR MEASUREMENTS IN A HORIZONTAL PIPE

(75) Inventor: Christian Wittrisch, Rueil Malmaison (FR)

(73) Assignee: Institut Francais du Petrole, Rueil-Malmaison (FR)

( * ) Notice: Under 35 U.S.C. 154(b), the term of this patent shall be extended for 0 days.

(21) Appl. No.: 09/169,145

(22) Filed: Oct. 9, 1998

(30) Foreign Application Priority Data

Oct. 13, 1997 (FR) ..... 97 12870

(51) Int. Cl.[7] ..... E21B 23/14; E21B 47/01

(52) U.S. Cl. ..... 166/384; 166/50; 166/65.1; 166/66; 166/385; 73/152.17; 73/865.8; 73/866.5; 405/154

(58) Field of Search ..... 166/50, 65.1, 66, 166/66.4, 77.2, 250.01, 384, 385; 73/152.17, 865.8, 366.5; 405/154, 156, 174, 184

(56) References Cited

U.S. PATENT DOCUMENTS

| | | | | |
|---|---|---|---|---|
| 3,401,749 | * | 9/1968 | Daniel | 166/772 X |
| 4,485,870 | | 12/1984 | Walulik . | |
| 4,676,310 | | 6/1987 | Scherbatskoy et al. | 166/65.1 |
| 4,901,804 | * | 2/1990 | Thometz et al. | 166/66 X |
| 4,951,758 | * | 8/1990 | Sonku et al. | 166/66 X |
| 5,111,880 | * | 5/1992 | Wittrisch et al. | 166/385 |
| 5,184,682 | * | 2/1993 | Delacour et al. | 166/385 |
| 5,353,872 | * | 10/1994 | Wittrisch | 166/385 X |
| 5,505,259 | * | 4/1996 | Wittrisch et al. | 166/65.1 X |
| 5,947,213 | * | 9/1999 | Angle et al. | 166/250.01 X |
| 6,003,606 | * | 12/1999 | Moore et al. | 166/50 X |

FOREIGN PATENT DOCUMENTS

| | | |
|---|---|---|
| 195 34 696 | 3/1997 | (DE) . |
| 0 352 148 | 1/1990 | (EP) . |
| 2 240 566 | 1/1991 | (GB) . |
| 93/18277 | 9/1993 | (WO) . |
| 98/02634 | 1/1998 | (WO) . |
| 98/12418 | 3/1998 | (WO) . |

OTHER PUBLICATIONS

Østvang, K.,et al., "Wireline tractor operations successful in horizontal wells," *World Oil,* vol. 218, No. 4, Apr. 4, 1997, pp. 125–126, 128, 130, 132.

"Downhole tractors expand extended reach possibilities," *Offshore,* vol. 55, No. 8, Aug., 1995, p. 28.

* cited by examiner

*Primary Examiner*—George Suchfield
(74) *Attorney, Agent, or Firm*—Millen, White, Zelano, & Branigan, P.C.

(57) ABSTRACT

A system and method for displacing instruments in a pipe having a portion thereof which is greatly inclined to the vertical. The system comprises in combination: a set of instruments mechanically linked to a first end of an electrically-powered displacement device, a semi-rigid composite rod that can be wound round a drum and at least one electric conductor. The method includes advancing the displacement device using the rod uncoiling from the drum. The system and method is of special use in inclined oil wells.

22 Claims, 2 Drawing Sheets

METHOD AND SYSTEM INTENDED FOR MEASUREMENTS IN A HORIZONTAL PIPE

FIELD OF THE INVENTION

The present invention relates to a system and to a method for measurement and/or servicing in wellbores or in pipes. The method is particularly well-suited to pipes comprising a substantially horizontal portion of rather great length.

BACKGROUND OF THE INVENTION

In the field of well logging, there are several well-known methods for displacing measuring instruments in greatly inclined or even horizontal pipes. It is possible to use drill rods made up end to end and equipped with a transmission cable placed in the inner space thereof, a continuous steel tubing (cabled coiled tubing) also comprising a transmission cable, or mechanical means for displacing measuring tools, such as hydraulically, electrically or electro-hydraulically-powered tractors. Measuring probe tractors are generally fed by an electric cable which supplies electric power to an electric motor driving a high-pressure hydraulic pump. The high-pressure hydraulic fluid actuates wheels placed against the wall of the well or of the pipe. The tensile or thrust force is of the order of 5 to 10 kN. These tractors are mechanically complex and costly because they cannot be too heavy, but they must however withstand the high pressures and temperatures to which they can be subjected in the pipe. Furthermore, the tensile strength of the electric feeder cable does not allow an excessive weight of the tractor. The power supply that can be transmitted is also limited. Moreover, the tensile or the thrust capacity depends on the coefficient of friction between the driving wheels and the wall of the pipe. This explains notably the relatively limited thrust or tensile capacities considering the weight of the feeder cable, the weight of the tractor itself and the weight of the tools to be displaced by the tractor. A conventional logging cable has a steel armouring with a rather high linear weight and wall friction coefficient. When a certain cable length is horizontal, the force of the tractor may not be sufficient to displace the total load. Furthermore, tractors cannot work in open holes because the rugosity of the rock face does not allow correct and effective contact of the driving wheels. Using a continuous coiled tubing equipped with an inner logging cable does not eliminate these drawbacks, on the contrary, because the linear weight thereof is even greater. Furthermore, the surface installation for maneuvering a coiled tubing is bulky and very costly.

SUMMARY OF THE INVENTION

The present invention thus relates to a system for displacing instruments in a pipe comprising a portion greatly inclined to the vertical. The system comprises in combination: a set of instruments mechanically linked to a first end of electrically-powered displacement means, a semi-rigid composite rod that can be wound round a drum and comprising at least one electric conductor. One end of the rod is fastened to the second end of said displacement means.

The instruments can comprise measuring sondes or probes, cameras, packer, plug or valve type well equipments, wall perforation tools.

The other end of the semi-rigid rod can be wound round a drum outside the pipe.

The pipe can comprise a portion sufficiently inclined to allow weights to move under the effect of gravity, and weighting bars can be connected to the other end of the semi-rigid rod, the bars being suspended in the pipe by a cable wound round a winch outside the pipe.

Extension means of determined length can be interposed between said displacement means and said instruments.

The extension means can comprise a semi-rigid rod length.

The present invention also relates to a method for displacing instruments in a pipe comprising a portion greatly inclined to the vertical. The method comprises the following stages:

- fastening a set of instruments to a first end of electrically-powered displacement means,
- connecting an end of a semi-rigid composite rod that can be wound round a drum and comprising at least one electric conductor to a second end of said displacement means,
- displacing said set in the pipe through a combined thrust action by means of the rod and of the displacement means.

In the method, said thrust can be exerted by means of the rod by actuating mechanical means for injecting the rod into the pipe.

The thrust can be exerted by means of the rod by fastening weighting bars to the other end of the rod, and by suspending said bars in the pipe by a logging type cable.

Extension means of determined length can be interposed between said instruments and said displacement means.

The method according to the invention can be applied to oil wells comprising a substantially horizontal portion.

In a variant, the method can be applied when the well comprises a lateral hole.

The method can be applied to inspection or control operations in rigid or flexible lines.

BRIEF DESCRIPTION OF THE DRAWINGS

Other features and advantages of the present invention will be clear from reading the description hereafter of non limitative examples, with reference to the accompanying drawings wherein.

DETAILED DESCRIPTION OF THE INVENTION

Figure 1:
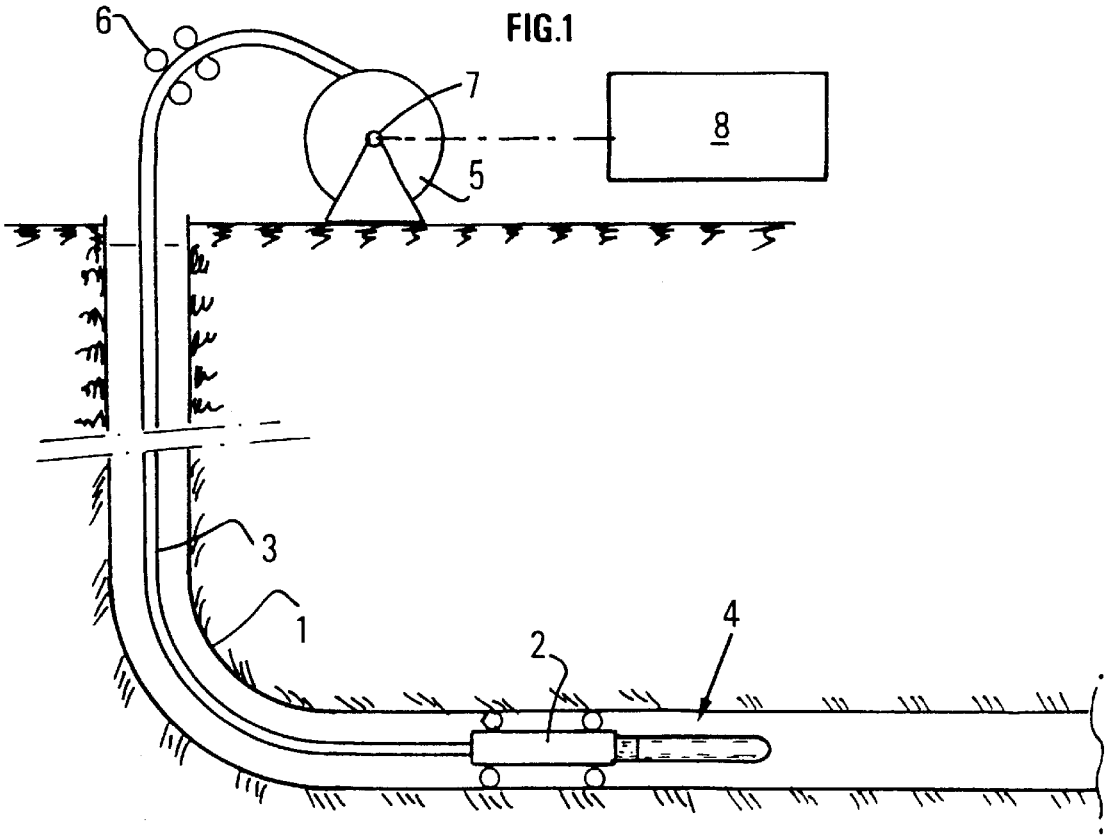
FIG. 1 diagrammatically shows the system according to the invention implemented in a well comprising a horizontal portion, FIG. 2 also diagrammatically shows a first variant, FIGS. 3A and 3B describe another variant relative to the layout of the pulled or thrust measuring and/or servicing elements.

FIG. 1 describes the system according to the invention used in a well 1 drilled in the ground, and comprising a vertical portion and a substantially horizontal portion. Displacement means 2 are connected to a semi-rigid composite rod 3 unwound from a drum 5 at the surface. Thrust or tensile means 6 specific to the rod can be used at the surface, downstream from the storage drum. The semi-rigid rod used can be in accordance with the description of document EP-352,148-B1 mentioned by way of reference. Said composite rod consisting of reinforcing fibers embedded in a thermoplastic or thermosetting matrix has a central core comprising at least one electric conductor. The conductors in the core supply the motive means of tractor 2 with electric power. Furthermore, the conductors or an optical fiber included in this core provide transmission of commands, information or data acquired by instruments 4 fastened to the end of tractor 2.

The semi-rigid rod is for example manufactured from glass fibers embedded in an epoxy, polyester or vinylester resin matrix in order to obtain a diameter of 19 mm, with a Young's modulus of 41,000 N/mm$^2$ and a linear density of about 0.6 kg/m.

Calculations show that such a rod fed into a well or a horizontal pipe with an inside diameter of 152.4 mm (6 inches) and full of water can have a length of about 950 m as the displacement limit, considering a friction coefficient of 0.1 between the rod and the wall of the pipe. According to calculations, the maximum length is inversely proportional to the friction coefficient. These calculations show that displacement means 2 do not need to pull semi-rigid rod 3 as long as the latter can be can be pushed by thrust means 6 or by the own weight of the vertical or substantially vertical rod part. It is clear that, for a horizontal well of several hundred meters, such a system allows tractor 2 to keep all of its capacity to push the instruments instead of pulling the horizontal part of the logging cable when injection means push the semi-rigid rod while the tractor is operating.

There are several downhole tractor types, for example those described in document WO-93/18,277. This tractor is operated and controlled from a logging cable whose weight is about 1500 kg in a 3000-m long horizontal well.

In FIG. 1, drum 5 comprises an electric and/or optical joint 7 for connecting the conductors or the optical fiber to a surface electronic installation 8.

Instruments 4 fastened to the end of tractor 2 can be made up of a logging type measuring sonde, of sets of pressure and temperature detectors, of well equipment tools, for example inflatable preventers (bridge plug, packer) or safety valves, perforating guns or video cameras. Generally speaking, said "instruments" are all the elements which may have to be set in a well or in a pipe. The total weight of the instruments does generally not exceed 1000 kg, which is perfectly compatible with the recognized tensile or thrust capacities of tractors 2, all the more so since all the instruments are generally on wheels in order to facilitate the displacement thereof. The system according to the invention allows a thrust to be exerted on the tractor, which is itself at work, by means of semi-rigid rod 3 over distances of several hundred meters. Above the maximum semi-rigid rod length which can be displaced horizontally through a thrust, the tractor pulls the semi-rigid rod while pushing the instruments. It is clear that the value of the traction to be exerted on the rod in order to continue the progression thereof in the horizontal well does not need to be very high because, in this case, it is only directly linked with the apparent weight and the friction of the additional rod length in relation to the maximum length, insofar as a thrust force is still exerted on the rod from surface installation 5 and 6. Said thrust force is approximately the critical force for which the semi-rigid rod no longer progresses. The tractor, moving through the agency of its own motive means, frees the rod when the latter is stuck due to buckling.

Figure 2:
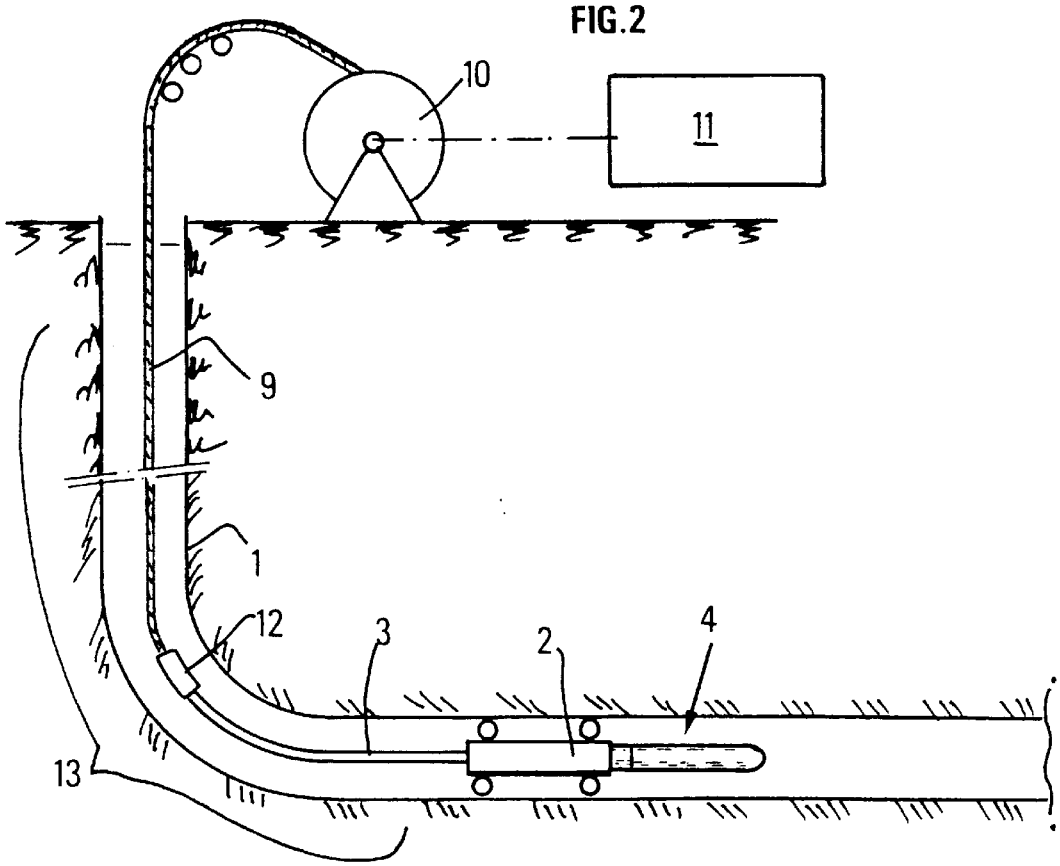

FIG. 2 shows a variant wherein the semi-rigid rod does not go up to the surface but is connected to a conventional logging type transmission cable 9. This cable is manoeuvred by a winch 10 comprising electrical and/or optical means linking cable 9 with an electronic information processing installation 11. According to the present invention, a tractor 2 is fastened to the end of semi-rigid rod 3. Instruments 4 are fastened to tractor 2.

A weight 12, generally in the form of bars, is fastened to the lower end of cable 9. The upper end of the semi-rigid rod is secured to said weighting bars 12.

This variants allows, in some cases, to use only a reduced length of semi-rigid rod 3. In fact, the thrust on semi-rigid rod 3 is exerted only through the action of weight 12 which is situated in a portion 13 of well 1 where gravity is effective to produce a force component along the axis of the well. The weight, in this variant, is maneuvering by the least expensive conventional devices, i.e. an armoured cable 9 and its winch 10. Of course, the conductors and/or the optical fibers of semi-rigid rod 3 are connected to the conductors and/or to the optical fibers of cable 9.

Figure 3A:
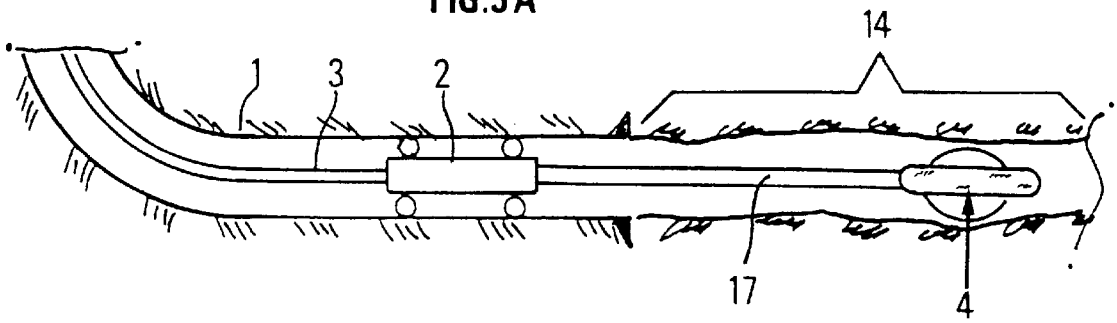
Figure 3B:
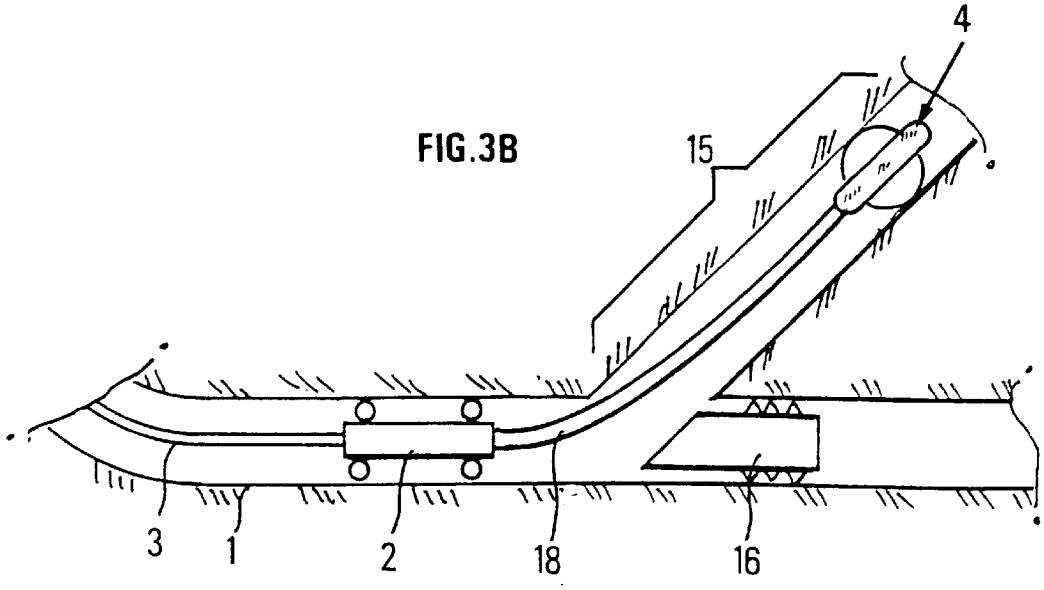

FIGS. 3A and 3B describe a variant of the two previous embodiments of the present invention. This variant relates more particularly to specific well 1 patterns.

In FIG. 3A, well 1 has an inside diameter corresponding to the inside diameter of the casing pipe cemented in the well. Well 1 is extended in the ground by a hole of smaller diameter 14, this diameter being at most the largest diameter of a drill bit that can be lowered in cased well 1. Tractor 2 works correctly on the smooth wall of the casing, but it cannot progress efficiently in an "open hole" type or uncased borehole. Two main causes: the overall diameter of the tractor is not compatible with the diameter decrease, or the driving wheels lose their efficiency on rough borehole walls. An extension 17 is therefore interposed between instruments 4 and the tractor, which allows to reach points remote from the cased zone of the well.

FIG. 3B shows a particular pattern of certain production wells comprising lateral holes 15 in relation to the substantially horizontal main well 1. For the same reasons as above, an extension 18 allowing instruments 4 to be displaced in lateral hole 15 while displacing the tractor according to the present invention in the cased main well 1 is advantageously used. A guide means 16 can be fed into main well 1 in order to help to feed instruments 4 into the lateral hole. This guide can be set and locked in place by the system according to the invention, the guide means being in this case lowered at the end of set of instruments 4.

Extensions 17 and 18 can be a portion of a semi-rigid rod of the same type as that bearing reference number 3, or of a smaller diameter because generally the stiffness required for exerting a thrust on the instruments can be lower than that of semi-rigid operating rod 3. In fact, the diameter of holes 14 or 15 is generally smaller, and the weight of the instruments can be lower than the load for which semi-rigid rod 3 is dimensioned.

However, the extensions can be made up of metal or composite rod elements screwed together. In this case, a cable link between measuring instruments 4 and the conductors and/or the optical fibers of semi-rigid rod 3 must be added to the system.

The present invention is not limited to wells drilled for hydrocarbon production, but it can also be applied in lines such as pipelines, or in boreholes from mine roads or tunnels for camera inspection or measurements.

What is claimed is:

1. A system for displacing instruments in a pipe (1) wherein the pipe has a portion greatly inclined to the vertical, the system comprising in combination: a set of instruments mechanically connected to a first end of electrically-powered, self-propelled displacement means including, a semi-rigid composite rod that can be wound around a drum and including at least one electric conductor therein, wherein one end of said rod is fastened to a second end of said displacement means for pushing said displacement means to facilitate advancement of the displacement means.

2. A system as claims in claim 1, wherein said instruments comprise measuring probes, cameras, a packer, plug or valve-type well equipment or wall perforation tools.

3. A system as claimed in claim 2, wherein another end of the semi-rigid rod is wound round a drum outside the pipe.

4. A system as claimed in claim 2, wherein the pipe comprises a portion that is inclined enough to allow weights to move under the effect of gravity, wherein weights are connected to said other end of semi-rigid rod and wherein said weights are suspended in the pipe by a cable wound around a winch outside of said pipe.

5. A system as claimed in claim 4, wherein extension means of determined length are interposed between said displacement means and said instruments.

6. A system as claimed in claim 5, wherein said extension means comprise a semi-rigid rod length.

7. A method or displacing instruments in a pipe having a portion greatly inclined to the vertical wherein the method comprises:

fastening a set of instruments to a first end of electrically-powered displacement means, connecting an end of a semi-rigid composite rod that can be wound around a drum and including at least one electric conductor therein to a second end of said displacement means, displacing said set of instruments in the pipe through a combined thrust action by means of rod and of said displacement means.

8. A method as claimed in claim 7, wherein said thrust is exerted by means of the rod by actuating a mechanical injector (6) for injecting the composite rod into pipe.

9. A method as claimed in claim 7, wherein said thrust is exerted by means of the rod by fastening weights to the other end of said rod, and by suspending said weights in the pipe by a logging type cable.

10. A method as claimed in claim 9, wherein extension means of determined length are interposed between said instruments (4) and said displacement means.

11. A system as claimed in claim 1, wherein another of the end of the semi rigid rod is wound round a drum outside the pipe.

12. A system as claimed in claim 1, wherein the pipe comprises a portion that is inclined enough to allow weights to move under the effect of gravity, wherein weights are connected to said other end of the semi-rigid rod and wherein said weights are suspended in the pipe by a cable wound around a winch outside of said pipe.

13. A system as claimed in claim 1, wherein extension means of determined length are interposed between said displacement means and said instruments.

14. A system as claimed in claim 3, wherein extension means of determined length are interposed between said displacement means and said instruments.

15. A method as claimed in claim 7, wherein extension means of determined length are interposed between said instruments and said displacement means.

16. A method or displacing instruments in an oil well having a portion with a horizontal component so as to extend substantially horizontal, the method comprising:

fastening a set of instruments to a first end of electrically-powdered displacement means, connecting an end of a semi-rigid composite rod that can be wound around a drum and including at least one electric conductor therein to a second end of said displacement means, displacing said set of instruments in the oil well through the horizontally extending portion with combined thrust action by said rod and said displacement means.

17. A method as claimed in claim 16, wherein said thrust is exerted by means of the rod by actuating a mechanical injector for injecting the composite rod into the well.

18. A method as claimed in claim 16, wherein said thrust is exerted by means of the rod by fastening weights to the other end of said rod, and by suspending said weights in the well by a logging type cable.

19. A method as claims in claim 16, wherein an extension of determined length is interposed between said instruments and said displacement means.

20. A method as claims in claim 16, wherein the portion with the horizontal component comprises at least one lateral hole.

21. The method of claim 7, wherein the pipe is rigid.

22. The method of claim 7, wherein the pipe is flexible.

* * * * *

UNITED STATES PATENT AND TRADEMARK OFFICE

CERTIFICATE OF CORRECTION

PATENT NO. : 6,173,787 B1
DATED : January 16, 2001
INVENTOR(S) : Christian Wittrisch It is certified that error appears in the above-identified patent and that said Letters Patent is hereby corrected as shown below:

Amend claims 2, 7, 16, 19 and 20 as follows:

Claim 2,
Line 1, change "claims" to -- claimed --.

Claim 7,
Line 1, change "or" to -- of --.

Claim 16,
Line 1, change "or" to -- of --.

Claim 19,
Line 1, change "claims" to -- claimed --.

Claim 20,
Line 1, change "claims" to -- claimed --.

Signed and Sealed this

Twenty-ninth Day of January, 2002

*Attest:*

*Attesting Officer*

JAMES E. ROGAN
*Director of the United States Patent and Trademark Office*